US010640260B1

(12) United States Patent
McAtarian et al.

(10) Patent No.: US 10,640,260 B1
(45) Date of Patent: May 5, 2020

(54) EQUIPMENT PALLET ASSEMBLY

(71) Applicant: Andax Industries LLC, St. Mary's, KS (US)

(72) Inventors: Mark McAtarian, St. Mary's, KS (US); Patrick F. McAtarian, St. Mary's, KS (US)

(73) Assignee: Andax Industries LLC, Saint Mary's, KS (US)

( * ) Notice: Subject to any disclaimer, the term of this patent is extended or adjusted under 35 U.S.C. 154(b) by 0 days.

(21) Appl. No.: 16/396,141

(22) Filed: Apr. 26, 2019

Related U.S. Application Data

(60) Provisional application No. 62/815,074, filed on Mar. 7, 2019.

(51) Int. Cl.
*B65D 19/44* (2006.01)
*B65D 19/14* (2006.01)

(52) U.S. Cl.
CPC ..... *B65D 19/44* (2013.01); *B65D 19/14* (2013.01); *B65D 2519/00029* (2013.01); *B65D 2519/00174* (2013.01); *B65D 2519/00497* (2013.01); *B65D 2519/00641* (2013.01); *B65D 2519/00815* (2013.01); *B65D 2585/86* (2013.01)

(58) Field of Classification Search
CPC ..... B65D 19/44; B65D 2519/00815; B65D 2519/0086; B65D 2585/86; B65D 37/00
USPC ..... 108/55.1, 55.5; 206/386, 595, 598; 220/9.1
See application file for complete search history.

(56) References Cited

U.S. PATENT DOCUMENTS 2,725,087 A 11/1955 Potter
3,478,869 A 11/1969 Walters
4,119,263 A * 10/1978 Cuthbertson ..... B65D 5/4208 222/528
4,132,310 A 1/1979 Dorsch
4,165,024 A * 8/1979 Oswalt ..... B65D 77/061 206/386
4,884,286 A 7/1989 Jacobson
5,111,937 A * 5/1992 Schutz ..... B65D 77/0466 206/386
5,190,089 A 3/1993 Jackson
5,385,268 A * 1/1995 LaFleur ..... B29C 66/1224 222/105
5,437,384 A * 8/1995 Farrell ..... B65D 19/12 220/1.5
5,653,354 A * 8/1997 Olson ..... B65D 77/061 206/511
5,897,012 A * 4/1999 Sortwell ..... B65D 19/12 206/600
6,079,934 A * 6/2000 Beale ..... B65D 88/1612 294/68.1
6,311,628 B1 11/2001 Smith et al.
(Continued)

OTHER PUBLICATIONS

"Xtra HD Transformer Sac" product description—found online at https://linestar.ca/specialty-items/transformer-containment/pad-pole-mount/xtra-hd-transformer-sac/.

*Primary Examiner* — Jose V Chen
(74) *Attorney, Agent, or Firm* — Hovey Williams LLP

(57) ABSTRACT

A pallet assembly (10) for safe handling and transporting of equipment such as a transformer (16) includes a lower pallet (12) with a containment bag (14). The pallet (10) is equipped with hold-down structure, allowing the transformer (16) to be secured thereto via straps (64). The bag (14) has a bottom wall (36) secured to pallet (12), and sidewall structure (16), which can be deployed to form a liquid-tight bag (14).

21 Claims, 3 Drawing Sheets

(56) References Cited

U.S. PATENT DOCUMENTS

| | | | | |
|---|---|---|---|---|
| 6,532,907 | B1 | 3/2003 | Harrison | |
| 6,575,629 | B1 * | 6/2003 | Perkins | B65D 77/061 220/9.4 |
| 7,500,786 | B2 * | 3/2009 | Richardson, Jr. | B65D 88/1618 220/495.08 |
| 7,819,269 | B2 * | 10/2010 | Perkins | B65D 19/18 220/1.6 |
| 7,886,778 | B2 * | 2/2011 | McDowell | B65D 5/545 141/10 |
| 8,777,001 | B1 | 7/2014 | Bennett | |
| 8,936,152 | B2 | 1/2015 | Shirrell et al. | |
| 9,010,531 | B2 | 4/2015 | Lowry et al. | |
| 9,061,822 | B2 * | 6/2015 | Ness | B65D 19/00 |
| 9,902,518 | B1 * | 2/2018 | Richardson | B65B 67/1205 |
| 10,047,875 | B2 * | 8/2018 | Qian | F16K 31/46 |
| 2003/0132275 | A1 * | 7/2003 | Ingalls | B65D 5/4266 229/117.3 |
| 2007/0151883 | A1 | 7/2007 | Smith et al. | |
| 2015/0027917 | A1 | 1/2015 | Goddard | |
| 2016/0074410 | A1 | 3/2016 | Clive-Smith et al. | |

* cited by examiner

EQUIPMENT PALLET ASSEMBLY

CROSS-REFERENCE TO RELATED APPLICATION

This application claims the benefit of U.S. Provisional Application Ser. No. 62/815,074 filed Mar. 7, 2019, which is incorporated by reference herein in its entirety.

BACKGROUND OF THE INVENTION

Field of the Invention

The present invention is broadly concerned with improved pallet assemblies for the handling and transport of equipment, such as electrical equipment containing environmentally hazardous oils or other liquids. More particularly, the invention is concerned with such assemblies including a base pallet together with a containment bag operably secured to the base pallet and designed so as to envelope and contain equipment placed on the base pallet. The pallet is equipped with hold-down structure so that the equipment may be rigidly secured in place by means of tie-down straps or similar expedients.

Description of the Prior Art

Conventional electrical transformers used in power distribution systems include a sealed, oil-filled tank with internal electrical components, such as transformer coils. These transformers also have external hardware, such as mounting equipment, connection busses, and lifting lugs.

These transformers are subject to leaking over time, resulting from damage to the transformer tank or from extended use. Such leakages can be environmentally damaging, inasmuch as the oil formulations within the transformers can often include hazardous chemicals (e.g., PCBs). In any event, it is necessary to safely transport failed transformers for disposal or repair, in accordance with governmental regulations. In like manner, other types of equipment, and especially electrical utility equipment, require safe and effective containment and shipping enclosures.

A number of different transformer containment devices have been provided in the past. For example, Andax Industries LLC has commercialized Xtra HD Pole-Mount Transformer Sac' containment bags, which have large, puncture-proof transformer bags with opposed perforated sections which can be opened to allow access to transformer lifting lugs. However, these bags do not provide any closures for these openings, and accordingly moisture or contaminants can enter the bags.

U.S. Pat. No. 8,777,001 describes another type of transformer containment bag which includes a bag with an internal liner and external lifting hoops. These kinds of bags are deficient, and indeed do not meet relevant regulatory standards, because the lifting lugs of the transformers cannot be accessed, thus requiring that the transformers be elevated and moved using only the bag components, which places considerable stress on the overall assemblies.

Other prior art references include: U.S. Pat. Nos. 2,725,087, 3,478,869, 4,132,310, 4,844,286, 5,190,089, 6,311,628, 6,532,907, 8,936,152, 9,010,531, and US Patent Publications Nos. US20070151883, US20150027917, and US20160075510.

Desirably, any handling and transport assembly for such equipment should meet Department of Transportation (DOT) Class 3 specifications, be relatively inexpensive, and easy to use in the field.

SUMMARY OF THE INVENTION

The present invention overcomes the problems outlined above and provides pallet assemblies operable to support and transport equipment having built-in lifting structure. Such assemblies comprise a pallet having an upper wall surface together with a containment bag including a bottom wall and sidewall structure, where the bottom wall is secured to the upper surface of the pallet. The bottom wall is adapted to receive and support equipment thereon, and the sidewall structure is deployable upwardly from the bottom wall to a position around and over the equipment. Hold-down structure secured to the pallet extends upwardly through the bottom wall and is within the confines of the containment bag. The hold-down structure is oriented relative to the equipment lifting structure to permit connection strap assemblies to be secured to the hold-down structure and engage the lifting structure, in order to maintain the equipment in position on the bag bottom wall. As used herein, "straps" or "strap assemblies" refer to any type of elongated structure serving to maintain the position of the equipment, such as straps, chains, or cables. A closure is provided to seal the sidewall structure when the latter is deployed around and above the equipment, in order to render the containment bag liquid-tight. In an embodiment, an absorbent pad is secured to the bag bottom wall within the confines of the bag.

Before use of the pallet assemblies, the sidewall structure is in a collapsed condition about the periphery of the pallet; however, once equipment is placed on the pallet, the sidewall structure is deployed upwardly to a position about and above the equipment, and is then sealed.

The pallet-mounted hold-down structure may comprise a plurality of spaced apart eye bolts each having a connection eye and a shank, with the shanks secured to the pallet, and the eyes thereof located above the bottom wall and within the bag.

The bottom wall and sidewall structure of the bag are usually formed of appropriate synthetic resin material(s), where the bottom wall has a greater thickness than that of the sidewall structure.

BRIEF DESCRIPTION OF THE DRAWINGS

While the drawings do not necessarily provide exact dimensions or tolerances for the illustrated components or structures, FIGS. 1-6 are to scale with respect to the relationships between the components of the structures illustrated therein.

DETAILED DESCRIPTION OF THE PREFERRED EMBODIMENT

Figure 2:
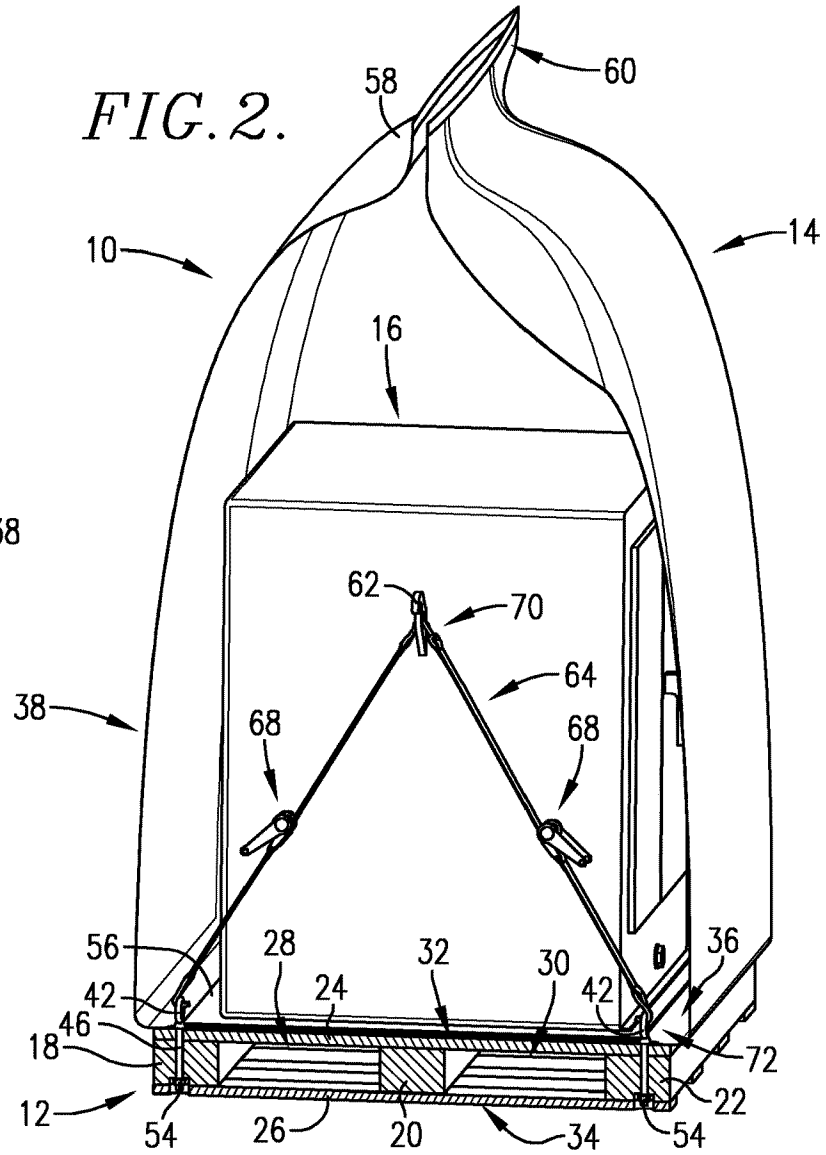
FIG. 2 is a sectional view of the assembly depicted in FIG. 1, illustrating the construction of the lower pallet and the containment bag, and illustrating a transformer situated within the containment bag and secured to the lower pallet.

Turning now to the drawings, a pallet assembly 10 broadly includes a lower base pallet 12 and a flexible containment bag 14 secured to the pallet 12. The bag 14 is designed to surround and envelop equipment, such as a transformer 16 positioned on the pallet 12. The design of the pallet assembly 10 permits transportation of equipment and meets DOT standards.

In more detail, the pallet 12 as depicted is a stringer pallet made up of three elongated, laterally spaced apart stringers 18-22 with interconnecting, transversely extending top and bottom deck boards 24 and 26 providing a pair of fork tongue openings 28 and 30. The upper surfaces of deck boards 24 cooperatively define a load-bearing upper surface 32 for the pallet, whereas the lower surfaces of the deck boards 26 cooperatively define a corresponding lower surface 34. The pallet 12 is intended to be a heavy-duty pallet, and thus the stringers 18-22 and deck boards 24 and 26 are preferably formed of hardwood stock.

Figure 6:
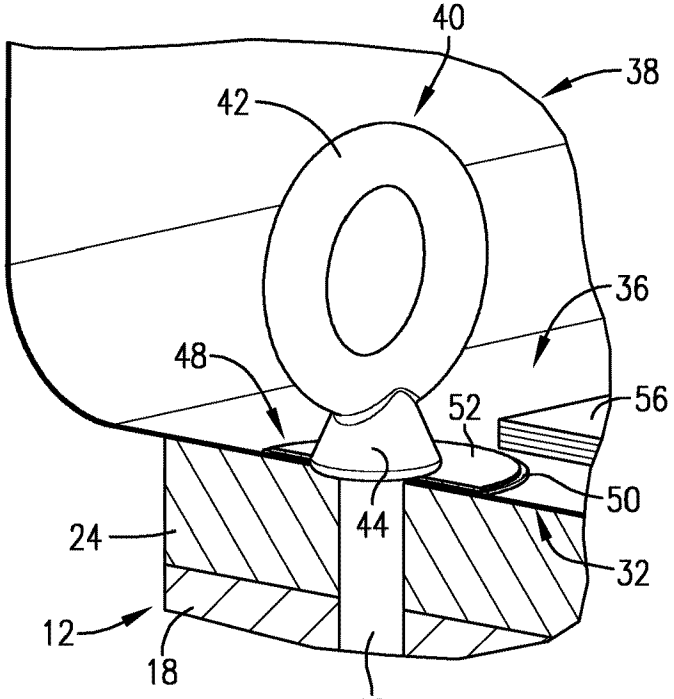
FIG. 6 is an enlarged, fragmentary view illustrating one of the hold-down eye bolts and the sealing arrangement about the base of the eye bolt.

The bag 14 includes an apertured, generally rectangular bottom wall 36 as well as flexible sidewall structure 38 secured to bottom wall 36. The bottom wall 36 is attached to the upper surface 32 of pallet 12 via hold-down structure, namely four corner-mounted eye bolts 40, the latter having a connection ring 42, a base 44, and a bottom-threaded shank 46 (see FIG. 6). In order to create an essentially liquid-tight bag 14, each eye bolt 40 has an annular sealing assembly 48 beneath the base 44 thereof, in the form of a compressible gasket 50 and with a metal washer 52 atop the gasket 50. As best seen in FIG. 2, each shank 46 extends through a corresponding bore provided at the ends of stringers 18 and 22, with the bottom end of the shank secured in place by a lock nut 54. The bottom wall 36 may be additionally secured to the upper surface 32 by means of adhesive (not shown). Advantageously, a compressible, liquid-absorbing pad 56 is affixed to the upper surface of bottom wall 36 remote from pallet 12. This pad 56 is designed to absorb any liquid which may be present during the use of assembly 10, and may affixed by any convenient means, typically by a suitable adhesive.

Figure 1:
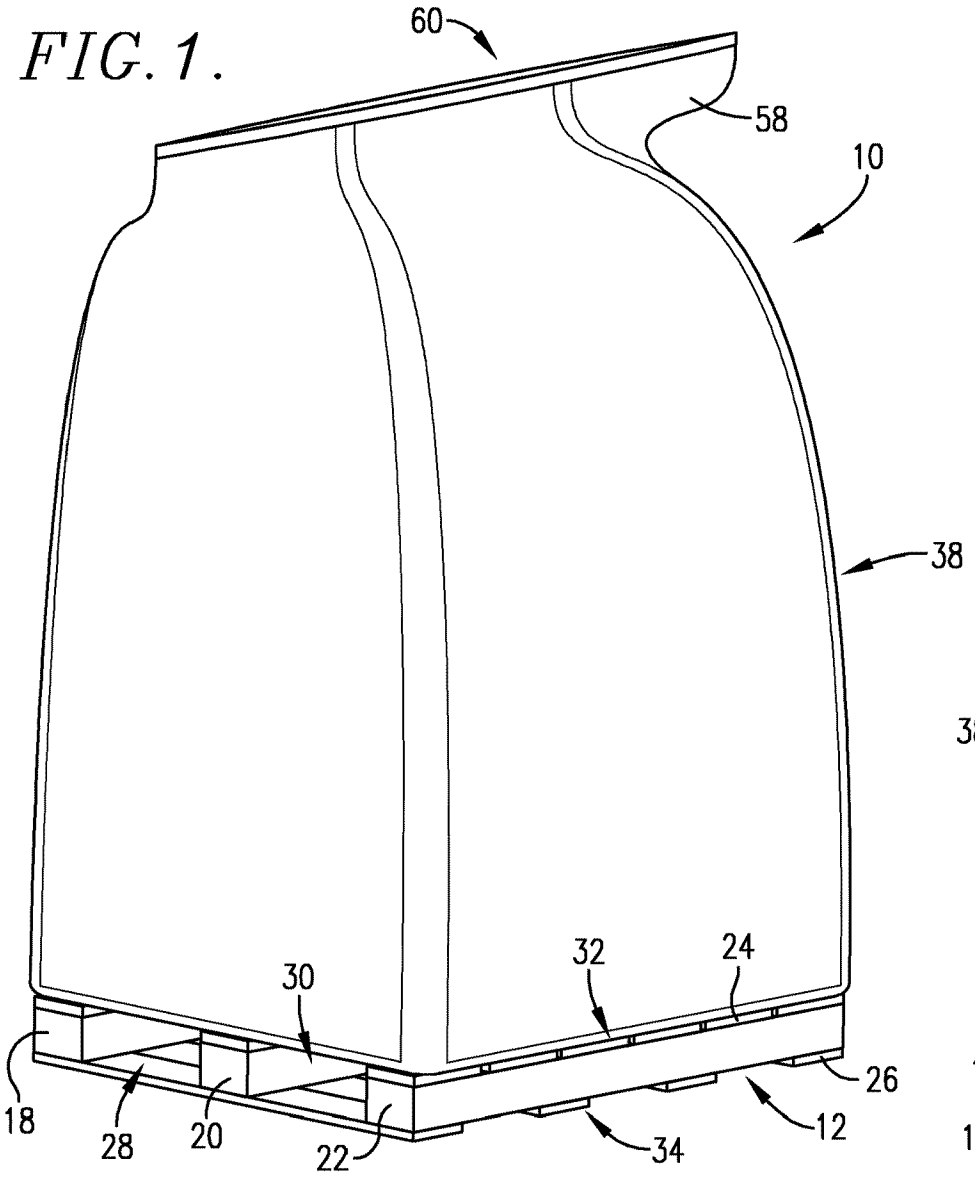
FIG. 1 is a perspective view of a pallet assembly in accordance with the invention, illustrated in its use condition and housing an electrical transformer.
Figure 3:
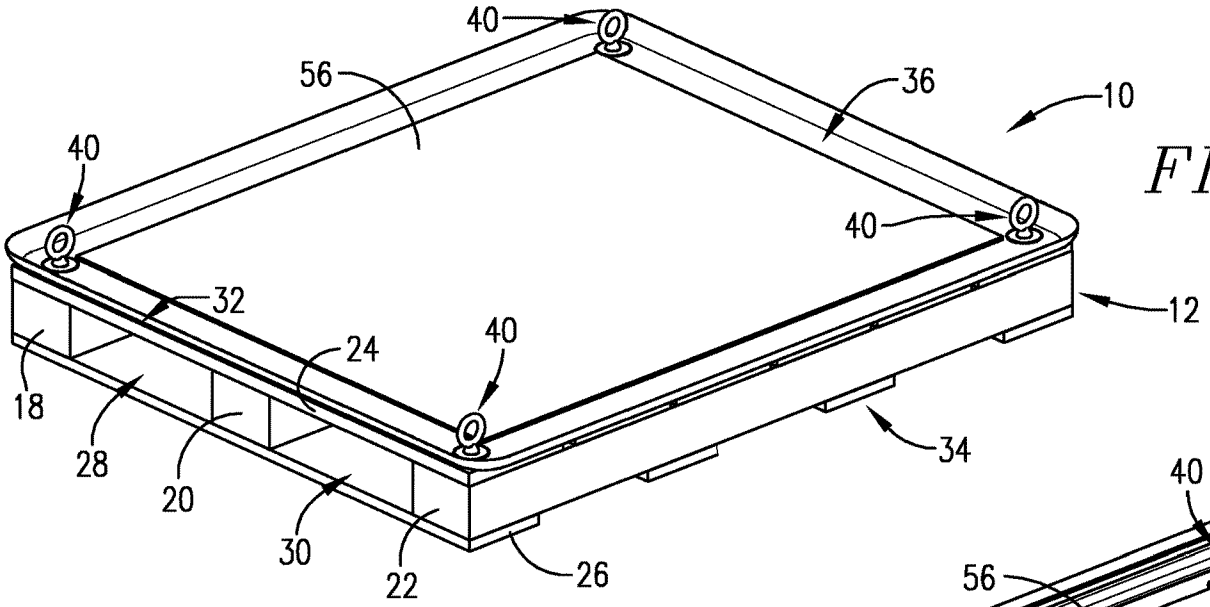
FIG. 3 is a perspective view illustrating the lower pallet depicted in FIGS. 1-2, the bottom wall of the containment bag, and the corner-mounted internal hold-down structure for equipment.
Figure 4:
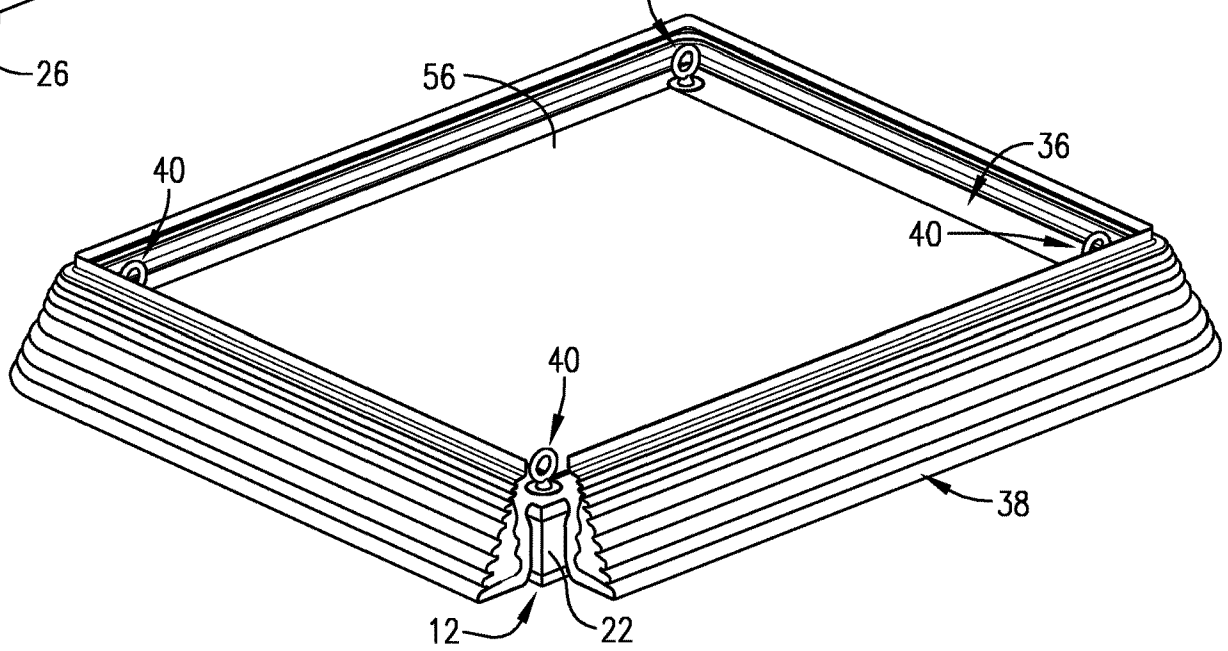
FIG. 4 is a view similar to that of FIG. 3, but depicting the deployable sidewall structure of the containment bag in a collapsed or shined condition around the containment bag bottom wall, and with a corner portion of the sidewall structure removed to better illustrate the sidewall construction.
Figure 5:
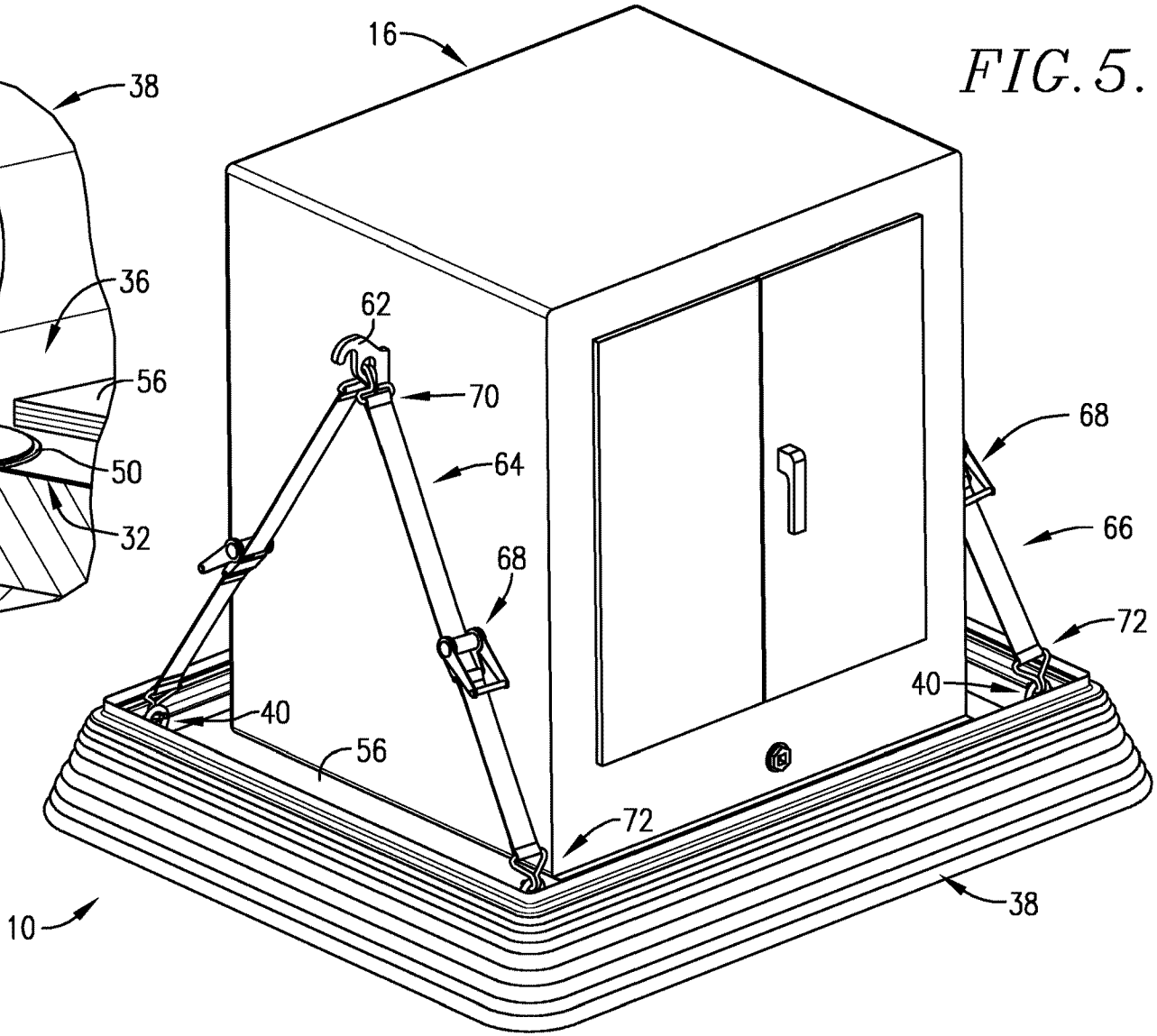
FIG. 5 is a perspective view of a transformer mounted on the pallet of FIG. 4, and secured by ratchet straps.

Sidewall structure 38 circumscribes the bottom wall 36 and is integrally secured thereto by heat welding or other means. Before use of pallet assembly 10, the sidewall structure 38 is in a collapsed or shined condition as illustrated in FIGS. 4 and 5. In this orientation, the pallet assembly may be conveniently stored or moved to a use location, ready to be employed for housing and transfer of equipment. However, the sidewall structure 38 is readily deployable by manually extending it upwardly to form an enclosure above pallet 12, as best seen in FIGS. 1 and 2. To this end, the upper margins 58 of structure 38 is equipped with a closure 60 allowing the bag to be closed in a substantially liquid-tight manner.

In the construction of pallet assembly 10, the apertured bottom wall 36 with an installed pad 56, and the lower margin of sidewall structure 38, are integrally connected by heat welding and/or adhesive. Suitably, the bottom wall 36 is formed of an appropriate synthetic resin material, such as polyester or polyvinyl chloride, and has a thickness of at least about 50 mils, more preferably about 68 mils. The pad 56 may be formed of hydrophobic melt-blown needle-punched polypropylene. Likewise, sidewall structure 38 is formed of synthetic resin material, such as 18 ounce reinforced polyvinyl chloride. The closure 60 may be in the form of an industrial grade Z-lok, although other closures may be employed.

In the use of pallet assembly 10 in the FIG. 4 configuration, equipment such as transformer 16 is initially placed on pad 56 using the side-mounted lifting lugs 62 thereof. Next, right- and left-hand connection strap assemblies 64 and 66 are used to secure the transformer 16 in place. As depicted, the strap assemblies 64, 66 include tightening ratchets 68, as well as endmost upper and lower hooks 70, 72. The upper hooks 70 are operatively connected with the associated lug 62, whereas the lower hooks 72 are installed on the eye bolt rings 42. The ratchets 68 are then used to tighten the straps. Other sorts of tie-down arrangements could also be employed, e.g., the equipment may be secured by crisscross straps, chains, or cables.

At this point, the sidewall structure 38 is deployed by pulling the structure upwardly to a position in surrounding relationship to the transformer 16, as illustrated in FIGS. 1 and 2. Finally, the closure 60 is manipulated to close the upper end of the sidewall structure and provide the desired liquid-tight seal. The entire assembly can then be safely loaded by means of a forklift or other similar expedient, and then transported to a disposal or repair site.

The invention is susceptible to a number of variations, apart from those described herein. For example, a stringer pallet has been depicted and detailed above. However, block pallets, flush pallets, perimeter base pallets, or skids can be used to equal effect. Similarly, while the disclosed pallets are fabricated from wood, useable pallets may be produced using metal or synthetic resin materials; and as used herein, the term "pallet" is intended to cover all such different designs.

While the invention has been described in the context of a transformer 16, it is not so limited. Rather, the pallet assemblies hereof may be used for a variety of equipment, such as liquid-containing electrical equipment, e.g., pad- or pole-mounted distribution transformers, switchgear, breakers, and reclosers, equipped with lifting structure in the form of lugs, eyes, or hooks; moreover, the invention is not limited to electrical equipment, but is equally useful in connection with any type of equipment of appropriate size which needs to be secured for transport or storage. In all of these contexts, the invention provides safe and environmentally friendly ways of handling and transporting such equipment.

We claim:

1. A pallet assembly operable to support equipment having lifting structure, said pallet assembly comprising:

a pallet having an upper wall surface;

a containment bag including a bottom wall and sidewall structure, said bottom wall secured to the upper surface of said pallet, said pallet adapted to receive and support said equipment thereon, said sidewall structure deployable upwardly from said bottom wall to a position around and over said equipment, when said equipment is located on said pallet and within said sidewall structure;

hold-down structure secured to said pallet and extending upwardly through said bottom wall and within the confines of said containment bag, said hold-down structure located to permit connection straps to be secured to the hold-down structure and engage the lifting structure, in order to maintain the equipment in position on said pallet; and a closure operable to seal said sidewall structure when the sidewall structure is deployed around and above said equipment, in order to render the containment bag liquid-tight.

2. The pallet assembly of claim 1, including an absorbent pad secured to said bottom wall and within the confines of said containment bag.

3. The pallet assembly of claim 1, said hold-down structure comprising a plurality of spaced apart eye bolts having a connection eye and a shank, the shanks of said eye bolts secured to said pallet, and the eyes thereof located within the confines of said containment bag, there being sealing structure around the eye bolt shanks to prevent escape of liquid from the containment bag.

4. The pallet assembly of claim 3, there being four eye bolts respectively located adjacent each corner of the pallet.

5. The pallet assembly of claim 1, said lifting structure comprising first and second spaced apart lifting lugs.

6. The pallet assembly of claim 1, said connection straps being ratchet straps.

7. The pallet assembly of claim 1, said bottom wall and sidewall structure formed of synthetic resin material.

8. The pallet assembly of claim 7, said bottom having a greater thickness than said sidewall.

9. The pallet assembly of claim 1, said sidewall structure being in a collapsed condition about the periphery of said pallet, and being deployable upwardly from the collapsed condition.

10. The pallet assembly of claim 1, said sidewall structure being heat-welded to said bottom wall.

11. The pallet assembly of claim 1, said closure comprising a manually engageable closure.

12. The combination comprising:

a pallet having an upper wall surface;

a containment bag including a bottom wall and sidewall structure, said bottom wall secured to the upper surface of said pallet;

liquid-containing equipment having lifting structure and positioned on said pallet and within said sidewall structure, said sidewall structure deployed upwardly from said bottom wall to a position around and over said equipment;

hold-down structure secured to said pallet and extending upwardly through said bottom wall and within the confines of said containment bag;

elongated connection straps engaging said lifting structure of said equipment and secured to said hold-down structure; and a closure sealing said deployed sidewall structure in order to render the containment bag liquid-tight.

13. The combination of claim 12, including an absorbent pad secured to said bottom wall, said equipment resting on said pad.

14. The combination of claim 12, said hold-down structure comprising a plurality of spaced apart eye bolts each having a connection eye and a shank, the shanks of said eye bolts secured to said pallet, and the eyes thereof located within said containment bag, there being sealing structure around the eye bolt shanks to prevent escape of liquid from the containment bag.

15. The combination of claim 14, there being four eye bolts respectively located adjacent each corner of the pallet.

16. The combination of claim 15, said lifting structure comprising first and second spaced apart lifting lugs, one pair of said eye bolts located to permit a first connection strap assembly to engage the first lifting lug and connect with said one pair of eye bolts, another pair of said eye bolts located to permit a second connection strap assembly to engage the second lifting lug and connect with said other pair of eye bolts.

17. The combination of claim 16, said first and second connection straps being ratchet straps.

18. The combination of claim 12, said bottom wall and sidewall structure formed of synthetic resin material.

19. The combination of claim 18, said bottom having a greater thickness than said sidewall.

20. The combination of claim 12, said sidewall structure being heat-welded to said bottom wall.

21. The combination of claim 12, said closure comprising a manually engageable closure.

* * * * *